US005878853A

United States Patent [19]

DeRouen et al.

[11] Patent Number: 5,878,853

[45] Date of Patent: Mar. 9, 1999

[54] LUGGAGE PULL

[76] Inventors: Mary Z. DeRouen, 7630 Greatwood Lake Dr., Sugar Land, Tex. 77479; Leslie R. Reynolds, 5314 Shady Maple Dr., Kingwood, Tex. 77339

[21] Appl. No.: 917,087

[22] Filed: Aug. 25, 1997

[51] Int. Cl.[6] ..... A45C 13/00

[52] U.S. Cl. ..... 190/116; 190/18 A; 16/114 R

[58] Field of Search ..... 16/114 R; 294/156, 294/165, 137; 280/37; 190/116, 115

[56] References Cited

U.S. PATENT DOCUMENTS

| | | | |
|---|---|---|---|
| 3,653,474 | 4/1972 | Sadow | 190/18 A |
| 3,913,172 | 10/1975 | Richards et al. | 16/114 B |
| 3,924,872 | 12/1975 | Sollazzi | 280/47.37 |
| 4,114,838 | 9/1978 | Knauf | 294/165 X |
| 4,402,542 | 9/1983 | Kreutzer | 294/156 |
| 4,558,896 | 12/1985 | Farnworth | 294/156 |
| 4,730,863 | 3/1988 | Guadnola | 294/156 |
| 4,838,396 | 6/1989 | Krenzel | 190/18 A |
| 5,090,691 | 2/1992 | Pollock | 16/114 B X |
| 5,405,002 | 4/1995 | Troia | 294/165 X |
| 5,566,870 | 10/1996 | Mejeur | 294/165 X |
| 5,704,672 | 1/1998 | Sims | 16/114 B X |
| 5,722,118 | 3/1998 | Hansen et al. | 16/114 R |

*Primary Examiner*—Gary E. Elkins
*Assistant Examiner*—Tri M. Mai
*Attorney, Agent, or Firm*—Donald H. Fidler

[57] ABSTRACT

A pull device for a wheeled luggage carrier which has a retractable handle for tilting and pulling of the luggage carrier where the pull device is readily attachable to the handle of the wheeled luggage carrier. The pull device has an elongated handle element configured symmetrically about the handle element axis and sized for gripping by a hand, an elongate extension element coupled to said handle element for extension in a direction substantially perpendicular to element axis, and fastening elements at the end of the extension element remote from the handle element for fastening the extension element to the handle of a wheeled luggage carrier where the handle is substantially perpendicular to the handle element axis when attached. The fastening elements are constructed and arranged to allow pivotal movement of the extension element. When the pull device is attached to the handle of a wheeled luggage carrier by the fastening means, the handle element is gripped by a person's hand with the attached arm in a natural plane of swinging movement when walking thereby permitting pulling of the luggage carrier without requiring rotation of the person's arm or hand from a normal position. The pull device is preferably constructed from lightweight, flexible materials.

2 Claims, 2 Drawing Sheets

LUGGAGE PULL

FIELD OF THE INVENTION

This invention relates to pulls for luggage carriers and more particularly to an inexpensive accessory for wheeled luggage which provides an ergonomic pull for travel luggage.

PRIOR ART

U.S. Pat. No 3,924,872 issued Dec. 9, 1975 discloses a pull strap for four wheel rolling luggage where the strap is snap connected to the luggage and provides a pull for the luggage.

U.S. Pat. No. 4,838,396 issued Jun. 13, 1989 relates to a multi wheeled luggage case where a strap is used for pulling.

U.S. Pat. No. 3,653,474 relates to a four wheel luggage piece where a flexible strap is used to pull the luggage.

The prior art does not disclose luggage pulls for tilted wheeled luggage.

BACKGROUND OF THE INVENTION

One form of popular luggage for travel has evolved to wheeled luggage carriers which have wheels on a bottom transverse edge of the luggage and an extendable handle which can be projected from the luggage case for tilting the luggage carrier onto the wheels and for pulling the luggage carrier. The extendable handle has a parallel transverse portion for grasp by a human hand where the closed fingers of the hand about the handle form a fist which faces either forward or rearward with respect to the torso which the hand is attached to. In this position, the arm with the pulling hand is rotated clockwise or counterclockwise with respect to the normal position of the hand and the arm relative to the torso. When the luggage carrier is pulled, the torso is subject to a twisting action because of the drag of the luggage carrier. The arm is also rotated at the shoulder toward the rear of the torso and the hand tends to move rearwardly of the torso What this produces is a bad and uncomfortable condition for the person pulling the luggage because the arm and hand and body are not in a normal position and are in a somewhat contorted position. This is exacerbated in some instances by the length of the extendable handle and the height of the person which changes the center of gravity of the luggage and the pulling characteristics.

SUMMARY OF THE PRESENT INVENTION

In the present invention a luggage pull system is provided for a wheeled luggage carrier which has a case means for containing articles and where the case means has a rectangular configuration and includes bottom and top surfaces which enclose four sides and where there are a plurality of wheels on a bottom surface disposed on a rolling axis to permit transitional movement when the luggage is pivoted to an inclined position. The case also has a retractable handle is movable between a retracted position relative to the top surface of the case means and an extended position where a handle portion permits tilting and transitional movement by pulling and the handle portion is parallel to said rolling axis.

The luggage pull extension includes an elongated tubular handle member sized for hand gripping and having a length to accommodate a full hand grip. Pull extension means couple the tubular handle member to the handle portion of the luggage carrier so that the tubular handle member is rotated 90° relative to said handle portion on said retractable handle member thereby to position a hand gripping the tubular handle member in a normal position relative to the torso for pulling a luggage carrier by transmitting a pulling force through the pull extension means to the handle portion of the carrier luggage while the tubular handle member is in a normal position.

In a preferred form of the invention, the pull extension means is constructed from a flexible yet firm web strap material where the web strap material has terminal ends which are attachable to the extendable handle portion. The terminal ends are separate from one another and extend in one direction from a stitched section of the web strap material where the web strap material extends in the other direction in a V shape configuration to a rigid or firm tubular handle member where the tubular handle member is arranged in a direction normal to the transverse width portion of the strap material. The terminal ends of the strap member have Velcro strips attached to their inner and outer surfaces. One of the terminal ends is tightly wrapped around the handle portion (preferably in a center location) and the other terminal end is wrapped over the first terminal end to firmly attach the terminal ends of the strap member below the stitched section to one another and to the handle portion. With the attached flexible pull extension, the luggage carrier can be pulled with the closed fingers of a hand arranged in a normal position with respect to the torso, with the arm not twisted and with the load of the luggage permitting the arm to be extended normally alongside of the torso by the force component of the luggage weight.

In another form of structure the pull extension is constructed from a length of flexible soft cord member which can be looped around and under the loop at a central location on the handle portion to couple the soft cord member to the handle portion. From the loop coupling of the cord member the cord member forms a V configuration to the ends of a rigid tubular handle member. When the cord member is looped to the handle portion, the rigid tubular handle is normal to the transverse portion of the luggage handle. When the rigid tubular handle is grasped by a hand the force component of the luggage weight pulls directly downward so that the wrist and arm are in a normal position and the body is not twisted when the luggage is pulled.

In still another form of the invention, the pull extension may take the form of a rigid bar member with an attached T handle and a cylindrically configured attachment clamp where the attachment clamp is coupled to a luggage handle and the T handle is in a direction normal to the direction of the luggage handle. When the rigid T handle is grasped by a hand, the force component of the luggage weight pulls directly downward so that the wrist and arm are in a normal position and the body is not twisted when the luggage is pulled.

DESCRIPTION OF THE PRESENT INVENTION

Figure 1:
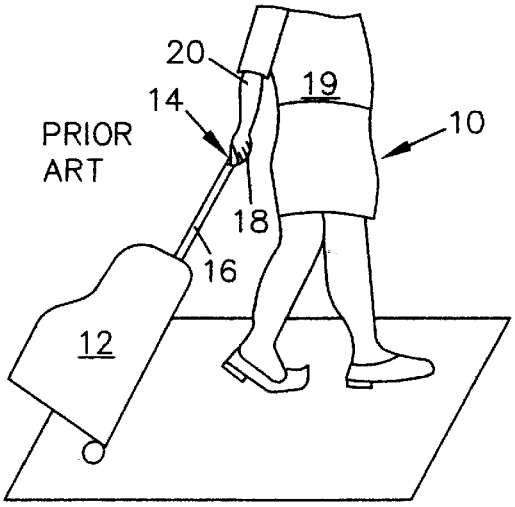
FIG. 1 is a schematic representation of a person and the arrangement of the torso and arm for pulling luggage according to the prior art.

As illustrated in FIG. 1, a person 10 pulling a wheeled luggage carrier 12 must grasp the transverse handle portion 14 of an extendable handle 16 with the fingers of the hand so that the fist 18 is either facing forward or rearward of the torso 19. In this position, the arm 20 is twisted and pivoted toward the luggage carrier 12. If a person is tall, the angle of tilt of the luggage is increased and typically the person must bend over slightly to pull the luggage. If a person is short of stature, the load is then applied to the twisted arm in an unnatural position.

Figure 2:
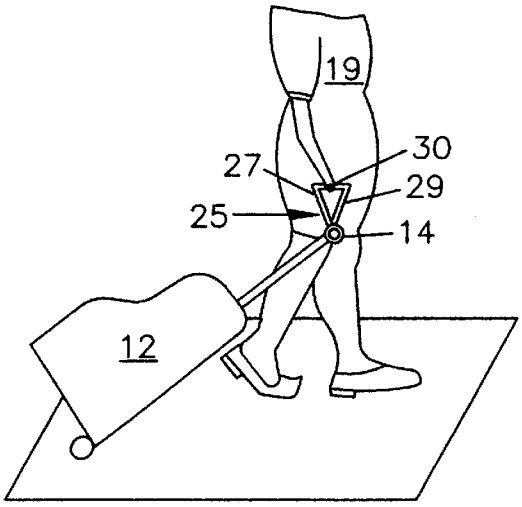
FIG. 2 is a schematic representation of a person and the arrangement of the torso and arm for pulling luggage according to the present invention.

In the present invention, as illustrated in FIG. 2, a luggage pull 25 is attached to the extendable handle 14 of a luggage carrier and the pull has strap portions 27, 29 which form a V configuration with respect to a tubular handle 30 located at the upper end of the strap portions. The tubular handle 30 is grasped by a hand naturally with the fingers and the plane of the fist is normal to the transverse portion of the handle 14 so that the arm is untwisted.

Figure 3:
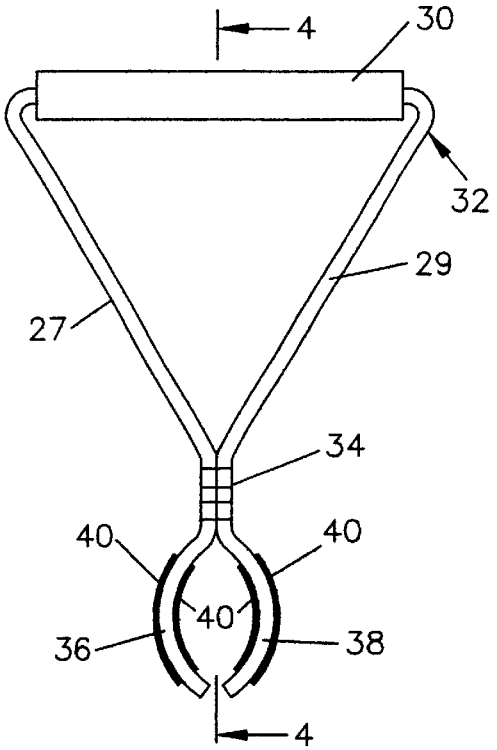
FIG. 3 is a plan view of one form of the present invention.
Figure 4:
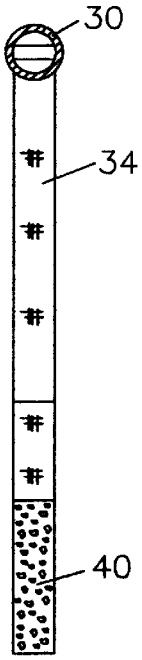
FIG. 4 is a view taken along line 4—4 of FIG. 3.
Figure 5:
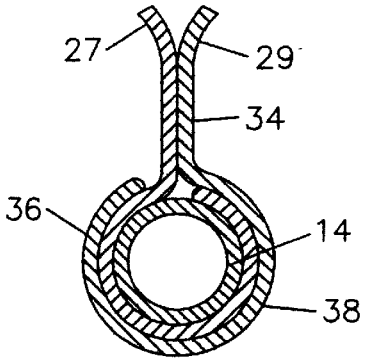
FIG. 5 is a partial view in cross section of the attachment ends of a strap on a luggage handle.

Referring now to FIG. 3, one form of a luggage pull embodying the present invention is illustrated. The luggage pull is constructed from a flexible web strap 32 which can, for example, be one inch wide where the strap 32 is passed through a tubular handle member 30. Equal lengths 27, 29 of the strap member extend from each end of the tubular member 30. The portions of the strap member on either side of the tubular member 30 are fastened together by stitching or the like at a location 34 proximate to the terminal or attachment ends 36, 38 of the strap member. The attachment ends 36,38 are provided with fastening means such as Velcro strips 40 in the inside and outside surfaces of the attachment ends 36,38. Velcro strips are hooked type fastening and contact pads In use, one of the attachment ends 36 is tightly wrapped around the circumference of the transverse portion of the luggage carrier handle 14 and then the other attachment end 38 is tightly wound over the first end 36 to provide a snug but rotatable fit of the attachment ends 36, 38 on the transverse portion of the luggage carrier handle 14 (see FIG.5). The luggage pull has a length of about six inches for an average person and can be made shorter for a shorter person or longer for a taller person.

Figure 6:
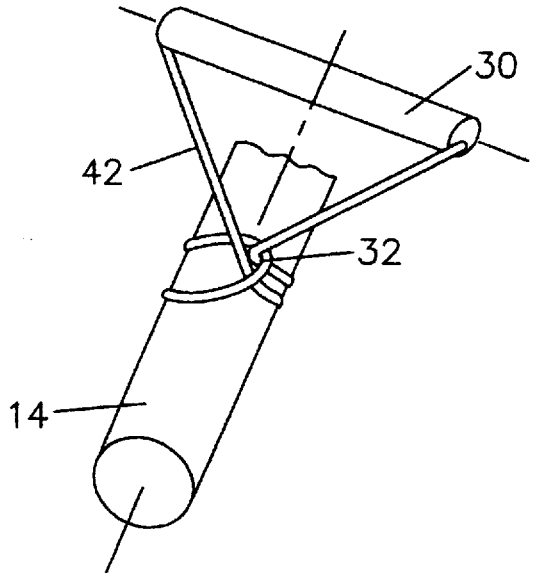
FIG. 6 is a perspective view of another form of the present invention which utilizes a soft cord rope.

Referring now to FIG. 6, another form of the invention is illustrated where the luggage pull consists of a flexible soft cord 42 (such as ⅜" Nylon) in a continuous loop where the loop extends into the ends of a rigid tubular handle 30. To attach the luggage pull, the nadir 32 of the loop with respect to the handle 30 is passed around the handle portion 14 of the luggage carrier and the handle 30 is passed through the loop at the nadir 30 to couple the cord firmly to the handle portion 14. The tubular handle 30 is naturally located normal to the axis of the luggage handle 14.

Figure 7:
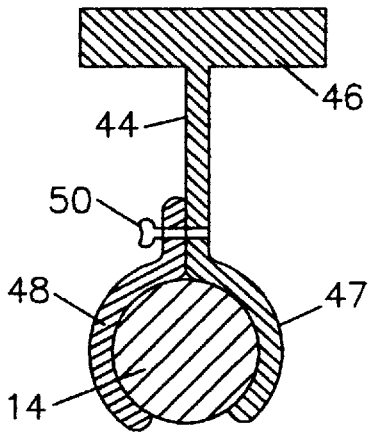
FIG. 7 is a view in cross section of another form of the present invention which utilizes a rigid plastic construction.
Figure 8:
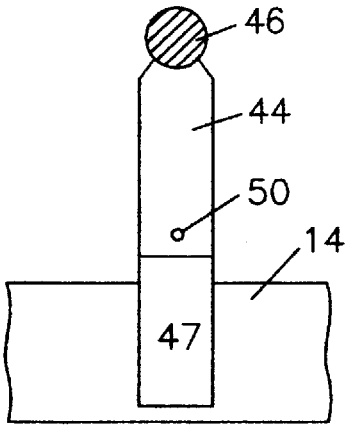
FIG. 8 is a view taken along line 8—8 of FIG. 7.

Referring now to FIG. 7 & FIG. 8, another form of the invention is illustrated where the luggage pull consists of a rigid bar extender 44 (such as a thermoplastic) which has a T handle 46 disposed normal to the plane of the bar extender 44. At the lower end of the luggage pull, is a clamp means formed by a curved half shell 47 on the bar extender 44 and a curved clamp shell 48 which attaches to the bar extender 44 by a bolt 50. The T handle 46 is naturally located normal to the axis of the luggage handle 14.

The gist of the invention is the balancing of the downward load of the luggage and use of a handle which is located at a 90° relationship with respect to the axis of the handle on the luggage carrier so that the luggage can be wheeled with the arm and hand in a normal position where the load is properly distributed to the torso in a natural position.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. In combination with an elongated wheeled luggage carrier having wheels at a lower terminal location and a luggage handle at an upper terminal location, a pull device for attachment to the handle of said wheeled luggage carrier, said pull device comprising:

an elongated rigid tubular handle element configured symmetrically about a handle element axis, said handle element being sized for gripping by a hand;

an elongated flexible web strap member sleeved through said tubular handle element to provide first and second strap portions of substantially equal length extending from the ends of the tubular handle element;

fastening means at the terminal ends of said first and second strap member portions for fastening said terminal ends to said handle of the wheeled luggage career, the sections of said first and second strap members located between said terminal ends and said tubular handle element having a length constructed and arranged for allowing a twisting movement of said strap member between the handle element and the terminal ends attached to the luggage carrier handle and for balancing the downward load of the luggage carrier so that when said pull device is attached to the handle of said wheeled luggage carrier, the handle element can be gripped by a person's hand with an attached arm thereof suitably located in a natural plane of arm swinging movement when wailing thereby permitting pulling of a luggage carrier without requiring rotation of the person's arm or hand from a normal position.

2. A pull device which is readily attachable to the handle of a wheeled luggage carrier, said pull device comprising:

an elongated rigid tubular handle element configured symmetrically about a handle element axis, said handle element being sized for gripping by a hand;

an elongated flexible web strap member sleeved through said tubular handle element to provide first and second strap portions of substantially equal length extending from the ends of the tubular handle element;

fastening at the terminal ends of said first second strap member portions for fastening said terminal ends to a handle of the wheeled luggage carrier, the sections of said first and second strap members located between said terminal ends and said tubular handle element having a length sufficient for allowing a twisting movement of said strap member between the handle element and the terminal ends attached to the luggage carrier handle so that when said pull device is attached to the handle of a wheeled luggage carrier, the handle element can be gripped by a person's hand with an attached arm thereof suitably located in a natural plane of arm swinging movement when walking thereby permitting pulling of a luggage carrier without requiring rotation of the person's arm or hand from a normal position; and means for joining said first and second strap portions to one another at a location between the free ends of the strap portions and the tubular handle member.

* * * * *